US008235098B2

(12) United States Patent
Agee

(10) Patent No.: US 8,235,098 B2
(45) Date of Patent: Aug. 7, 2012

(54) HEAT EXCHANGER FLAT TUBE WITH OBLIQUE ELONGATE DIMPLES

(75) Inventor: Keith Agee, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 1208 days.

(21) Appl. No.: 12/019,017

(22) Filed: Jan. 24, 2008

(65) Prior Publication Data

US 2009/0188655 A1 Jul. 30, 2009

(51) Int. Cl.
*F28D 1/053* (2006.01)
*F28F 1/42* (2006.01)

(52) U.S. Cl. ..... 165/148; 165/78; 165/170; 165/177; 165/179

(58) Field of Classification Search ..... 165/177, 165/157, 76, 78, 148, 170, 179
See application file for complete search history.

(56) References Cited

U.S. PATENT DOCUMENTS 3,165,815 A * 1/1965 Wogerbauer ..... 29/897
3,258,832 A * 7/1966 Gerstung ..... 165/148
3,810,509 A * 5/1974 Kun ..... 165/148
4,011,905 A * 3/1977 Millard ..... 165/170
5,050,671 A * 9/1991 Fletcher ..... 165/148
5,111,878 A * 5/1992 Kadle ..... 165/176
5,538,077 A * 7/1996 So et al. ..... 165/109.1
5,692,559 A * 12/1997 Cheong ..... 165/148
6,047,769 A * 4/2000 Shimoya et al. ..... 165/148
6,920,918 B2 7/2005 Knecht et al.
6,938,685 B2 * 9/2005 Duerr et al. ..... 165/148
2007/0000652 A1 * 1/2007 Ayres ..... 165/158

FOREIGN PATENT DOCUMENTS

WO WO2007005479 1/2007

* cited by examiner

*Primary Examiner* — Leonard R Leo
(74) *Attorney, Agent, or Firm* — Alston & Bird LLP

(57) ABSTRACT

A flat tube for a heat exchanger having a stack of such flat tubes. The flat tube has a plurality of spaced-apart dimples formed on each of its opposite faces. At least some of the dimples on each face have an elongate plan shape, at least some of the elongate dimples being obliquely oriented such that their major axes form oblique angles with a longitudinal axis of the tube. The obliquely oriented elongate dimples are positioned such that when two of the tubes are stacked, the obliquely oriented elongate dimples on opposing faces of the tubes contact one another and the major axes of each contacting pair of elongate dimples are non-parallel to each other. Each contacting pair of elongate dimples of adjacent tubes thus forms a "cross" or "X".

8 Claims, 9 Drawing Sheets

HEAT EXCHANGER FLAT TUBE WITH OBLIQUE ELONGATE DIMPLES

BACKGROUND OF THE INVENTION

The present disclosure generally relates to heat exchangers, and more particularly relates to heat exchangers having a stack of a plurality of flat tubes that each carries a fluid through its interior, with the flat tubes being spaced apart by raised projections or dimples on the flat faces of the tubes, wherein the dimples of one tube contact the dimples of the adjacent tube so as to space the flat faces apart by twice the dimple height. In this manner, flow paths are defined between the spaced-apart flat faces for flow of another fluid so that heat exchange can take place with the fluid flowing through the interiors of the flat tubes. Typically, a fluid at a relatively high temperature is passed through the interiors of the tubes, a coolant at a lower temperature is passed through the spaces between the tubes, and heat is transferred between the fluids to cool the high-temperature fluid.

In such flat tube stacks, it is known that in addition to being useful for spacing the tubes apart, the external dimples are also effective for inducing turbulence in the fluid flowing through the spaces between the adjacent tubes. Accordingly, the dimples are also sometimes referred to as "turbulators" that induce "turbulation" in the fluid flow. Such turbulation can be beneficial for enhancing the heat transfer rate between the fluids, and can also help to prevent boiling of the fluid. Typically, the dimples are round in plan shape.

Round dimples provide moderate turbulation, but in many cases a greater degree of turbulation would be desirable.

Additionally, the top or outermost surfaces of the round dimples that contact each other are relatively small and thus do not provide much stability when stacking the tubes. Accordingly, it is not uncommon for assembly of the tube stack to be faulty because of one tube slipping relative to the adjacent tube such that the dimples "nest", resulting in too small a spacing between the tubes. Furthermore, because of the small contact areas of the round dimples, even relatively small tolerances on the dimple locations can make it more likely that the dimples will nest. If not corrected, the resulting improper tube spacing would cause undue flow restriction in the coolant and impair proper performance of the heat exchanger.

BRIEF SUMMARY OF THE DISCLOSURE

The present disclosure relates to a flat tube and a heat exchanger having a stack of a plurality of such flat tubes, wherein a special dimple configuration and arrangement provide enhanced stability for stacking of the tubes. In some embodiments the dimples essentially preclude nesting of tubes. The dimple configuration and arrangement also provide enhanced turbulation relative to conventional round dimples.

In accordance with one embodiment of the invention, a flat tube comprises a tube having a first face that is generally flat and an opposite second face that is generally flat, the tube having an interior passage open at opposite first and second ends of the tube for flow of a fluid into one end and out the other end. A plurality of spaced-apart dimples are formed on each of the first and second faces. At least some of the dimples on each face have an elongate plan shape as viewed perpendicular to the respective face such that each elongate dimple has a length along a major axis greater than a width of the elongate dimple along a minor axis, at least some of the elongate dimples being obliquely oriented with the major axes forming oblique angles with a longitudinal axis of the tube. The obliquely oriented elongate dimples are positioned such that when two of the tubes are stacked, the obliquely oriented elongate dimples on opposing faces of the tubes contact one another and the major axes of each contacting pair of elongate dimples are non-parallel to each other. Each contacting pair of elongate dimples of adjacent tubes thus forms a "cross" or "X". It is thought that such elongate dimples can substantially increase the amount of turbulation in the coolant flow.

Additionally, the crossing elongate dimples provide much larger contact areas than do round dimples, substantially reducing the likelihood of nesting.

In a preferred embodiment of the invention, the flat tube also includes orientation indicators comprising projections from each of the first and second faces and each having a height exceeding the height of the dimples but not exceeding twice the height of the dimples. The orientation indicators are located on each of the first and second faces of the tube in positions such that when two of the tubes are correctly oriented relative to each other in a tube stack the orientation indicators on the opposing faces of the tubes allow the elongate dimples on the opposing faces to contact one another to space the opposing faces apart by twice the height of the dimples. However, when the tubes are incorrectly oriented relative to each other (e.g., by reversing one tube end-over-end relative to its proper orientation) the orientation indicator on one tube contacts the orientation indicator on the other tube and prevents the elongate dimples from contacting each other, thereby indicating improper orientation of the tubes.

The orientation indicators can be used in a flat tube having the elongate dimples, but are also useful with flat tubes having other dimple configurations such as round dimples. In the case of flat tubes having the above-described obliquely oriented elongate dimples that cross when contacting one another, the orientation indicators prevent the tubes from being stacked in any way other than the proper way in which the elongate dimples contact one another in the crossing manner.

In one embodiment, the orientation indicator on the first face of the tube is positioned proximate to the first end of the tube, and the orientation indicator on the second face is positioned proximate to the second end of the tube. Each orientation indicator is positioned to align with a region of the flat face of an adjacent tube that is flat (i.e., where there is no dimple) when the two tubes are properly oriented with respect to each other.

In one embodiment, the elongate dimples are arranged on each face in a two or more rows extending parallel to the longitudinal axis and spaced apart in a width direction of the tube. In a particular embodiment, there are three and only three rows of elongate dimples on each face, and the elongate dimples in one of the rows (preferably the middle of the three rows) on each face have the major axes oriented substantially parallel to the longitudinal axis of the tube, while the elongate dimples in the other rows on each face have the major axes oriented obliquely to the longitudinal axis.

In one embodiment, the obliquely oriented elongate dimples in one of the rows on each face have the major axes inclined in an opposite direction from the longitudinal axis in comparison to the obliquely oriented elongate dimples in another of the rows.

The major axes of the obliquely oriented elongate dimples can form an angle relative to the longitudinal axis of about 20° to about 45°. The height of the elongate dimples is about 5% to 30% of a thickness of the tube measured between the first face and the second face. The length of each elongate dimple is about 10% to about 30% of a width of the tube measured perpendicular to the longitudinal axis between opposite side edges of the tube.

The present disclosure also relates to a heat exchanger having a shell defining an inner chamber, and a stack of the above-described flat tubes disposed in the inner chamber.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present disclosure relates to heat exchangers used for reducing the temperature of a fluid stream passed through the heat exchanger. The heat exchangers in accordance with this disclosure can be used with vehicles generally and, more particularly, can be used to cool an exhaust gas stream from an internal combustion engine. However, it will be readily understood by those skilled in the relevant technical field that the heat exchanger configurations of the present disclosure can be used in a variety of different applications.

Figure 1:
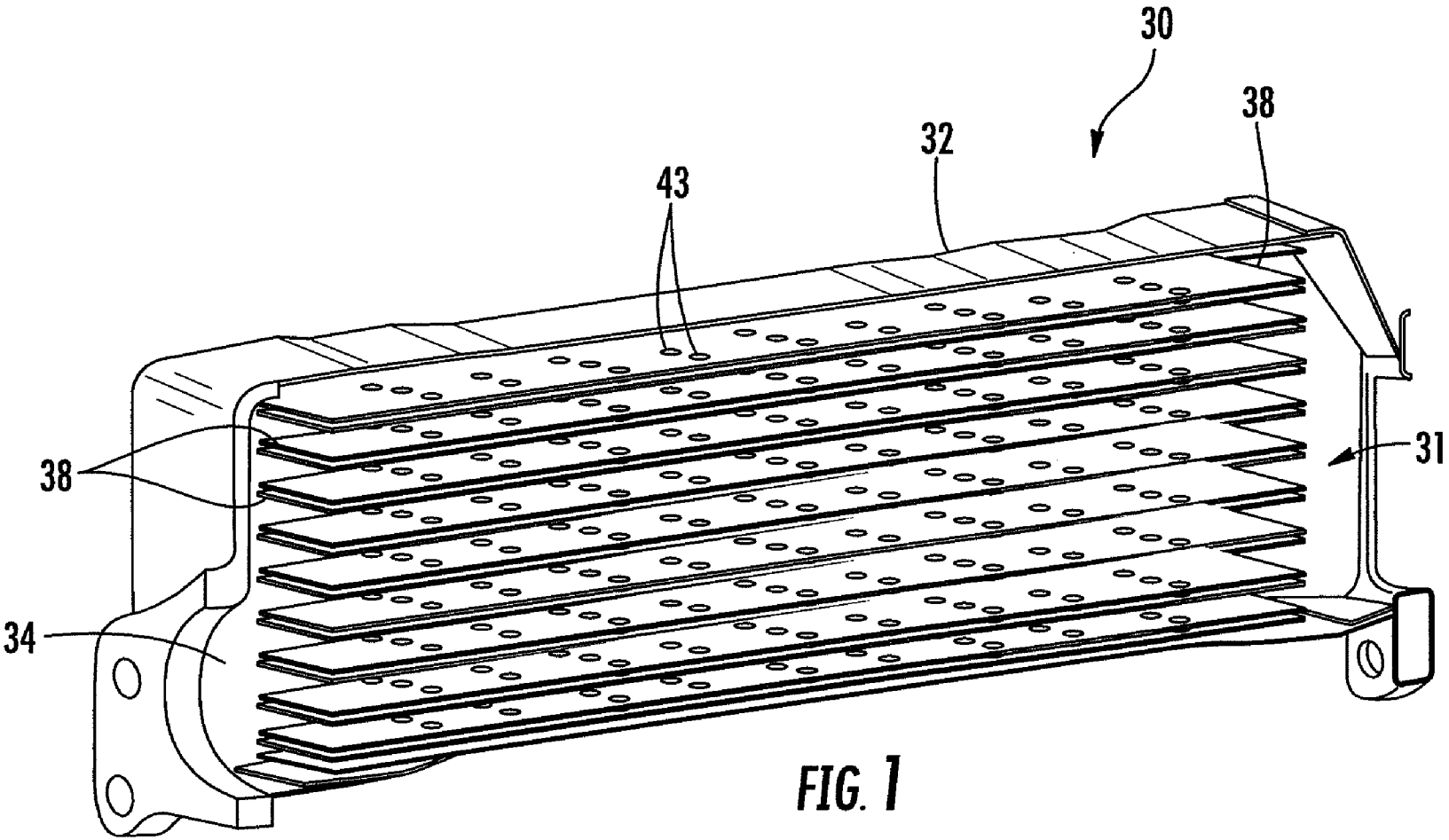
FIG. 1 PRIOR ART
FIG. 1 is a perspective view, partially broken away to show internal details, of a shell and tube heat exchanger in accordance with the prior art.
Figure 2:
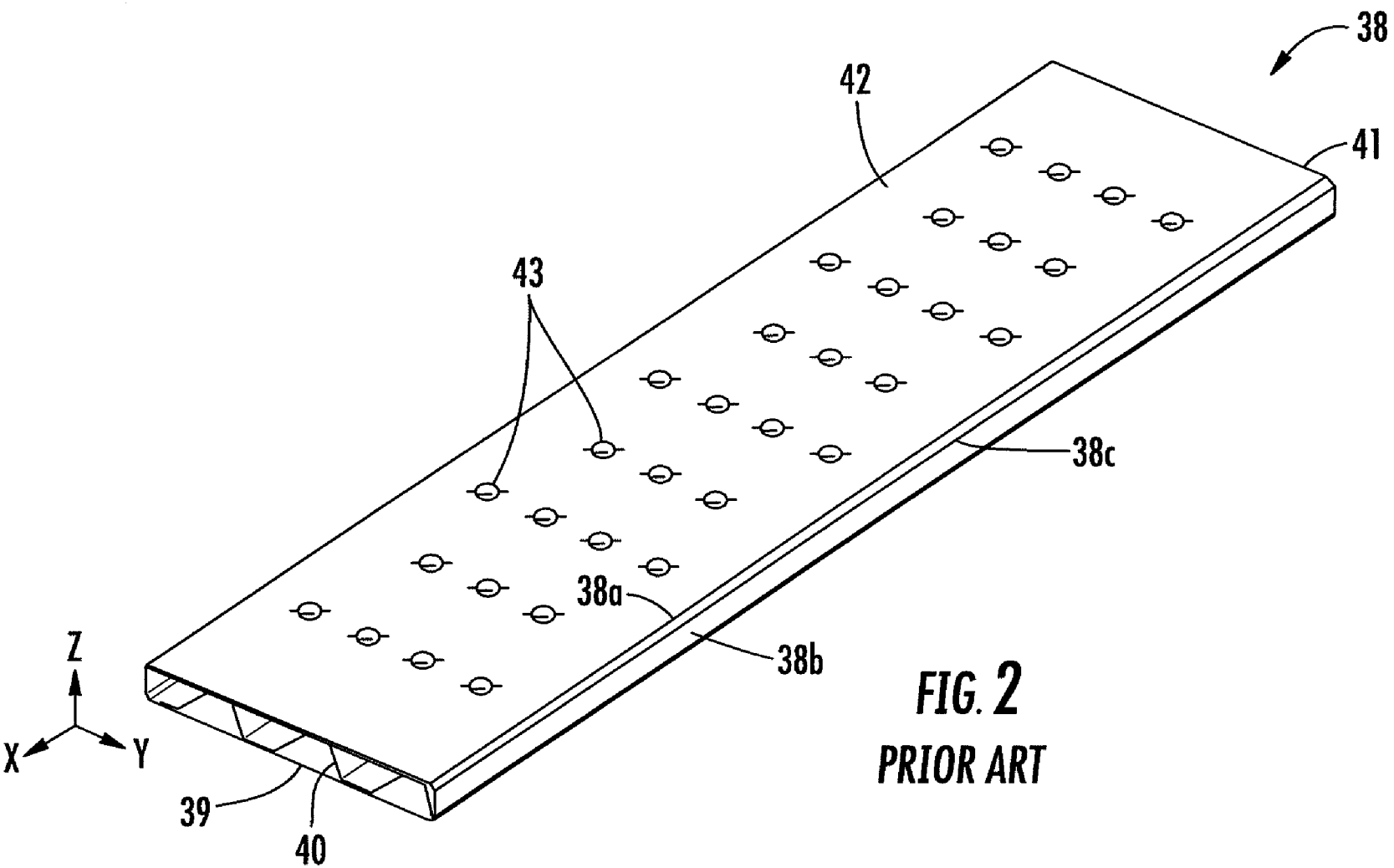
FIG. 2 PRIOR ART
FIG. 2 is a perspective view of a flat tube having round dimples in accordance with the prior art.
Figure 3:
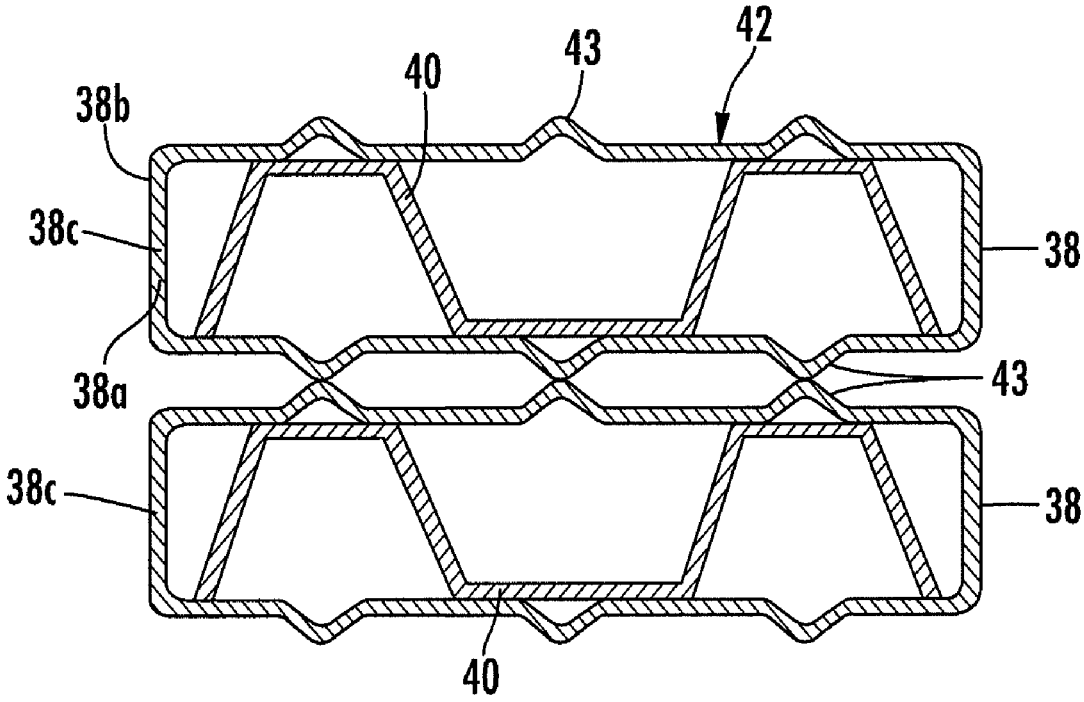
FIG. 3 is a cross-sectional view through two tubes in the tube stack of the heat exchanger of FIG. 1, along a plane that is normal to the longitudinal axes of the tubes.

FIGS. 1 through 3 show a heat exchanger 30 that does not include the features of the present invention. Generally, the heat exchanger comprises a stack of elongated, dimpled, flattened tubes that are enclosed in a surrounding shell. FIG. 1 illustrates a perspective view of the heat exchanger 30, sectioned to show the interior of the heat exchanger. The heat exchanger 30 comprises a tube stack 31 formed from a plurality of elongated and flattened tubes 38 that are arranged in a stack disposed within a shell 32. A header plate 34 is positioned adjacent both ends of the tube stack 31, and operates to connect the tubes 38 together adjacent the tube ends, seals the tubes 38 from the coolant, and provides a structure for connecting the tube stack 31 to the shell 32.

The shell 32 is configured to surround the tube stack and includes a coolant inlet and a coolant outlet to facilitate passage of a desired cooling fluid or medium therethrough. The shell can be formed from suitable structural materials such as metals, metal alloys and the like having desired structural and mechanical properties enabling use in such a heat exchanger application. The shell can be formed of a single piece of material. In a preferred embodiment, the shell 32 is made from a stainless steel material. The shell can be made by molding process or by hydroforming or end expanding a seam-welded rectangular tube. The shell 32 is configured to surround the tube stack and facilitate a desired degree of coolant circulation therein to provide a desired degree of heat transfer contact with the tube stack.

As is shown in FIG. 1, the tube stack 31 comprises a plurality of individual flat tubes 38 that are stacked on top of one another. As best shown in FIG. 2, each tube 38 in the tube is formed from a single sheet of material that has a pair of edges 38*a* and 38*b* that extend longitudinally along a length of the tube running between tube ends 39 and 41. The tubes can be formed by bending the sheet of metal into a desired configuration that will provide opposed tube outside surfaces to facilitate stacking and connection with adjacent tubes as better explained below. For example, the tube can be formed by bending the metal sheet about itself to provide a central passage defined by a wall structure configuration that has a generally rectangular or flattened oval cross section. During the process of forming the tube, the edges 38*a* and 38*b* are positioned adjacent or abutting one other, and are attached to each other to form a seam 38*c* that runs lengthwise along the tube. In one embodiment the tube is formed in a high-speed tube rolling mill (10 to 100 m/min speed). The tube edges 38*a* and 38*b* are attached to one another by a bonding process such as brazing, welding or the like, and can be attached by TIG or high frequency welding, or can be attached without a welded joint by brazing together.

The tube 38 can include a flow element 40 disposed therein. The flow element 40 can be provided in the form of a corrugated member or the like that extends a partial or complete length of the tube. The flow element 40 can be referred to as a fin or a turbulator, and can form a further flow path within the tube, operate to increase the gas or fluid contact surface area within the tube, and operate to increase flow turbulence therein, which can aid in cooling the fluid flowing through the tubes 38. Additionally, the fin or turbulator can function to add structural rigidity to the tube if desired.

As shown in FIGS. 2 and 3, the tubes 38 are configured each having opposite generally flat faces 42 that include a plurality of projections 43 or dimples extending outwardly therefrom. The projections 43 are formed on the faces 42 by a process of stamping, embossing, or the like. In an example embodiment, where the projections are provided in the form of dimples, the dimples can either be rolled or stamped into the material in the tube mill prior to the tube radii forming operation. In accordance with this prior heat exchanger, the projections 43 are configured having a circular cross section and having a rounded outside surface shape. The projections can extend a predetermined distance or height from the tube face, which distance can vary depending on a number of factors such as the type of coolant being passed through the shell, the desired flow rate or residence time for the coolant, and the like. As an example, the projections can have a height in the range of from about 0.5 mm to 2 mm, and more preferably about 1 mm, wherein the tubes are sized having a length of from about 110 mm to 720 mm, and a width extending between the lengthwise edges in the range of from about 40 mm to 120 mm.

As shown in FIG. 3, adjacent tubes 38 are arranged and oriented with one another so that when they are placed in a stacked position, the projections 43 of adjacent tubes 38 make contact with one another. This arrangement of tubes with adjacent projections in contact with one another operates to define a plurality of spaces or channels 47 between the outside surfaces of adjacent tubes that can conduct a flow of a coolant therethrough. The projections are arranged along the tube surface in a manner that gives rise to a plurality of coolant passages 47 that are configured to influence the passage of coolant through the tube stack in a manner that improves thermal transfer within the heat exchanger. The projections 43 of the adjacent tubes can be brazed or welded together in the tube stack. Alternatively, the projections of the adjacent tubes can just be in contact with another without being bonded together.

As previously noted, the round projections or dimples 43 in this prior flat tube 38 have a number of drawbacks, which the present invention seeks to overcome or alleviate.

A flat tube 100 in accordance with one embodiment of the invention is shown in FIGS. 4 through 8. The tube 100 is similar in overall construction to the tube 38 previously described, differing primarily in terms of the configuration and arrangement of the projections on the opposite flat faces 102, 104 of the tube. More particularly, the tube 100 includes a plurality of elongate dimples 110*a*, 110*b*, 110*c* (collectively referred to as 110) formed on one face 102, and a plurality of elongate dimples 112*a*, 112*b*, 112*c* (collectively referred to as 112) formed on the opposite face 104. Each elongate dimple 110, 112 has a plan shape, as viewed perpendicular to the respective face 102, 104 on which it is formed, that is elongate such that a length of the elongate dimple along a major axis A (FIG. 8) is greater than a width of the dimple along a minor axis B. For example, the length of the dimple can be at least about 1.5 times the width.

The dimples 110, 112 on the tube 100 are configured and arranged such that when two tubes are stacked together with the face 102 of one tube opposing the face 104 of the other, and the tubes are properly oriented and aligned with each other, the elongate dimples 110 on the face 102 contact the elongate dimples 112 on the face 104.

As illustrated, at least some of the elongate dimples 110, 112 are oriented with their major axes A oblique with respect to a longitudinal axis of the tube 100. More specifically, the dimples 110 are arranged in three rows 110*a*, 110*b*, and 110*c* each of which extends parallel to the longitudinal axis of the tube, the rows being spaced apart in the width direction of the tube. The elongate dimples 110*a* in the row adjacent one longitudinal side edge of the tube are oriented with their major axes A forming a positive angle $+\alpha$ relative to the longitudinal axis of the tube. The elongate dimples 110*b* in the middle row are oriented with their major axes A substantially parallel to the longitudinal axis of the tube. The elongate dimples 110*c* adjacent the other longitudinal side edge of the tube have their major axes A forming a negative angle $-\alpha$ relative to the longitudinal axis of the tube. Thus, the elongate dimples 110*a* and 110*c* are arranged to form a "V" or chevron configuration.

Figure 4:
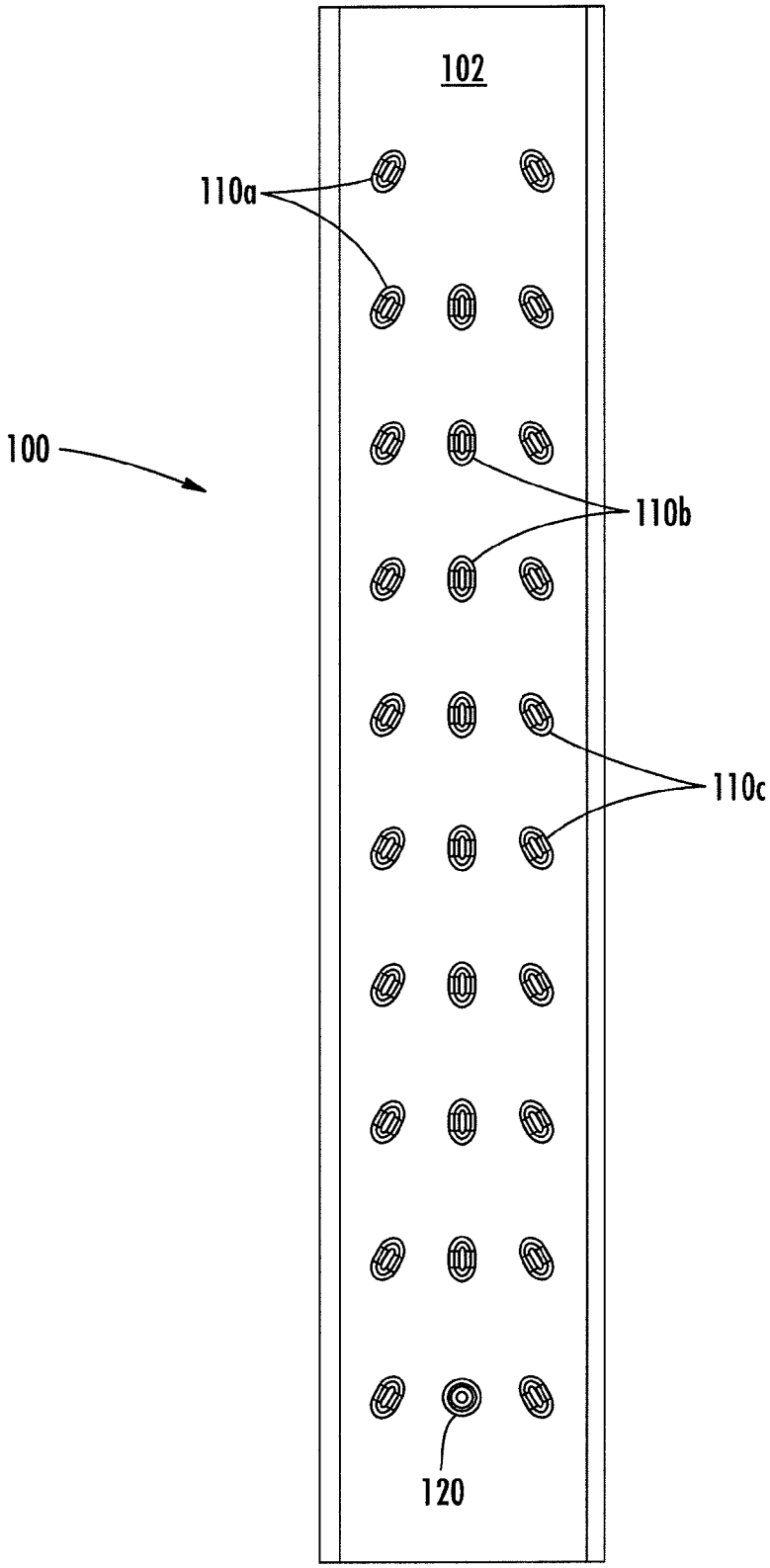
FIG. 4 is a top elevation of a flat tube in accordance with one embodiment of the invention.
Figure 6:
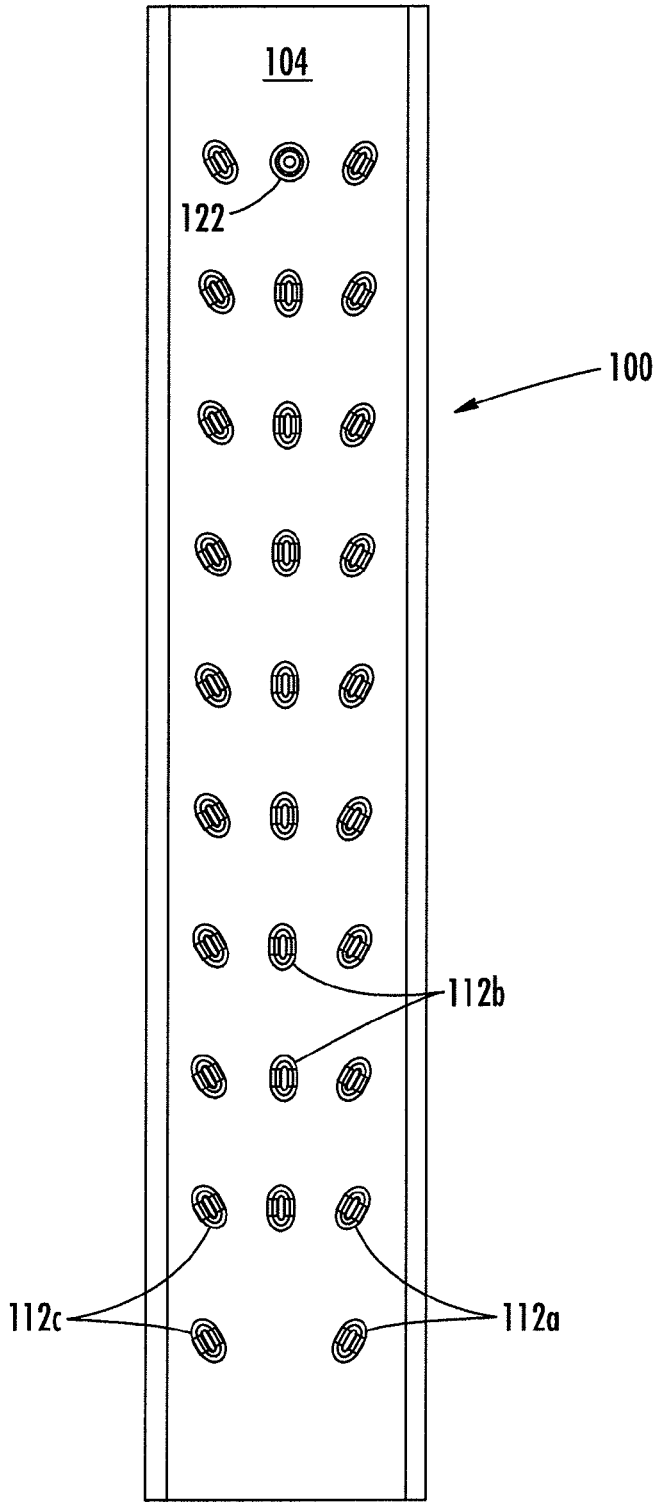
FIG. 6 is a bottom elevation of the flat tube of FIG. 4.
Figure 7:
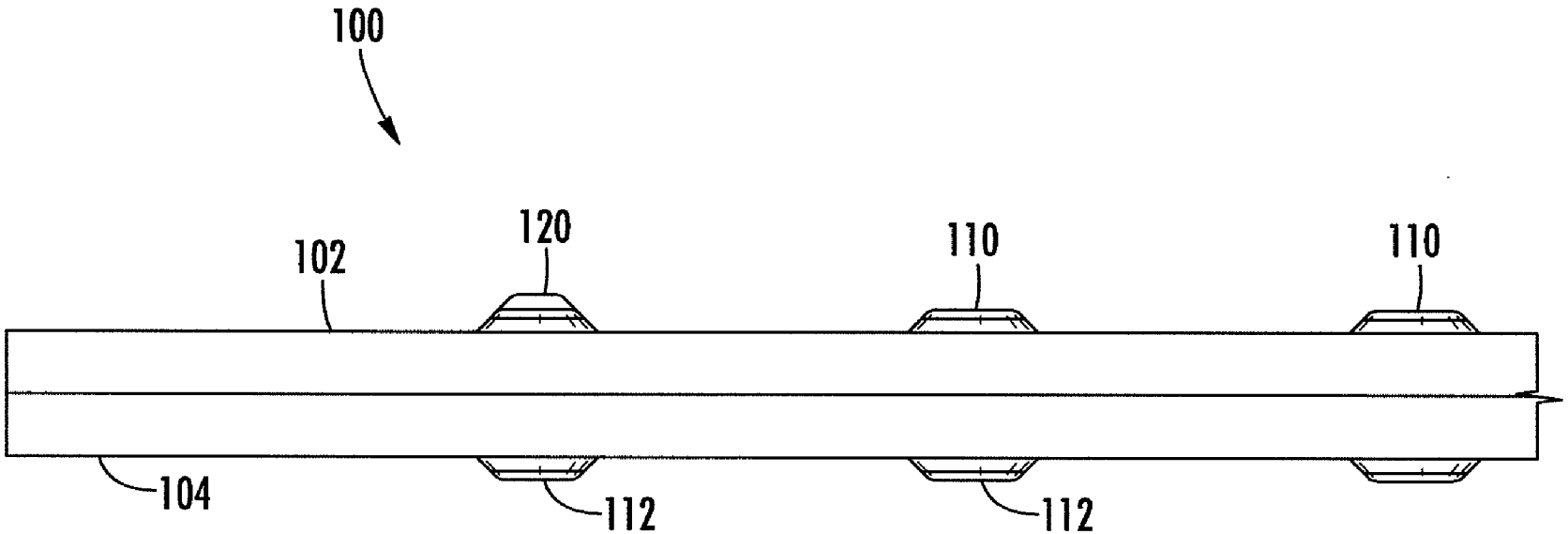
FIG. 7 is a magnified fragmentary side elevation of a portion of the flat tube of FIG. 4.
Figure 8:
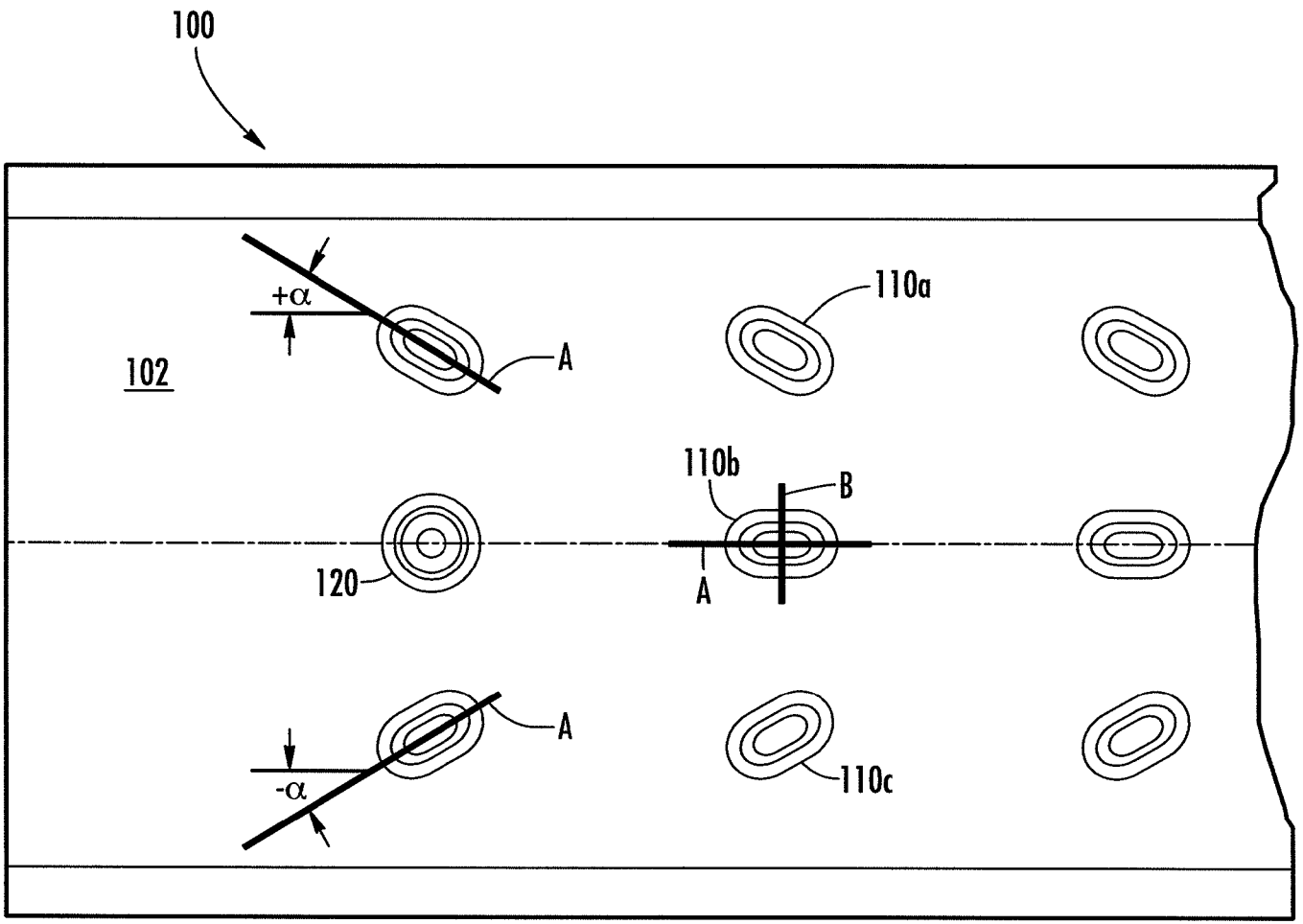
FIG. 8 is magnified fragmentary top elevation of a portion of the flat tube of FIG. 4.

As can be seen by comparing FIGS. 4 and 6, which respectively show the faces 102 and 104 of the tube, the elongate dimples 112 on the face 104 are similarly arranged in three rows, with the middle row having elongate dimples 112*b* oriented with their major axes parallel to the longitudinal axis of the tube, and the other two rows of elongate dimples 112*a*, 112*c* having their major axes oriented at positive and negative oblique angles with respect to the longitudinal axis. More specifically, the dimples 110*a* are oriented at a negative angle $-\alpha$ and the dimples 110*c* are oriented at a positive angle $+\alpha$ relative to the longitudinal axis. Additionally, the dimples 110*a* and 112*a* are positioned so that they will contact one another when one tube is stacked with its face 102 opposing the face 104 of the other tube.

Figure 9:
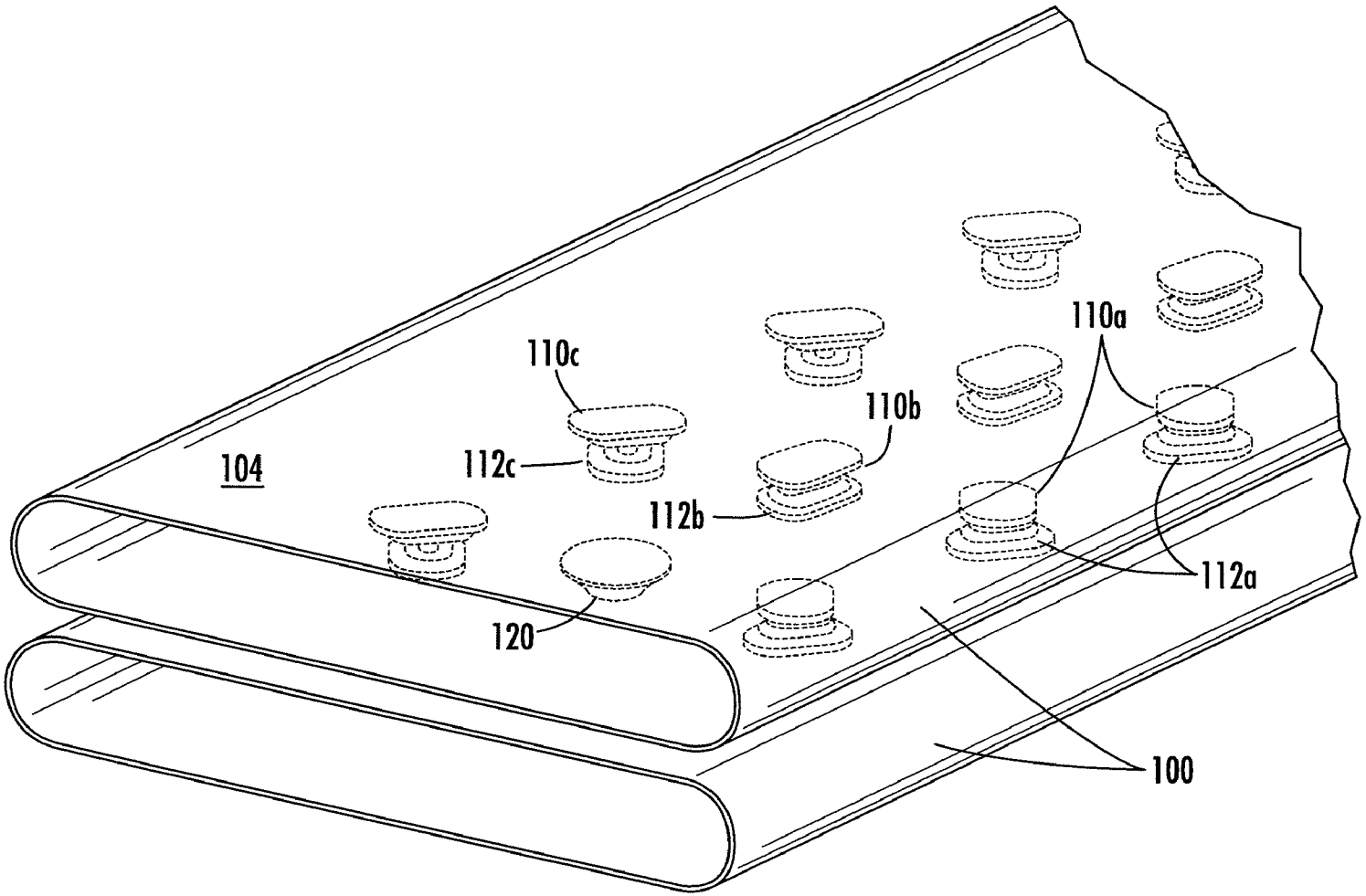
FIG. 9 shows two tubes in accordance with FIG. 4 stacked one on the other.

FIG. 9 illustrates two tubes 100 stacked together and shows the upper tube in a transparent fashion so that the dimples on the opposing faces of the tubes are visible. In FIG. 9, the face 104 of each tube faces upwardly and the opposite face 102 of each tube faces downwardly, such that the face 102 of the upper tube opposes the face 104 of the lower tube. Thus, the dimples 110*a* of the upper tube contact the dimples 112*a* of the lower tube, the dimples 110*b* of the upper tube contact the dimples 112*b* of the lower tube, and the dimples 110*c* of the upper tube contact the dimples 112*c* of the lower tube. Each pair of contacting dimples 110*a*, 112*a* forms a "cross" or "X" intersection because their major axes are non-parallel to each other. Similarly, each contacting pair of dimples 110*c*, 112*c* forms a "cross" or "X" intersection. The contacting pairs of non-oblique dimples 110*b*, 112*b* have their major axes parallel to each other and parallel to the longitudinal tube axis. Alternatively, however, the dimples in the middle row could also be oblique, although the illustrated arrangement has symmetry about a longitudinal midline bisecting the tubes into halves, which is thought to be desirable for facilitating a uniform distribution of fluid flow (in the tube width direction) within the passages defined between the faces of the adjacent tubes.

The crossing pairs of elongate dimples 110, 112 offer the potential of enhanced turbulation of the coolant flow through the passages between the tubes, relative to conventional round dimples.

Additionally, as previously noted, a further advantage of the elongate dimples is a substantially increased amount of contact area between the dimples relative to round dimples. Furthermore, particularly when the dimples are obliquely arranged so they cross each other, the new dimple design provides a substantially reduced sensitivity to positional tolerances of the dimples in terms of the prevention of "nesting" of the dimples of adjacent tubes.

Thus, the oblique elongate dimples as described significantly improve upon round dimples in a number of respects. However, it is still possible (although less likely) for the dimples to nest if the tubes are not properly oriented relative to each other. Furthermore, if the tubes are not properly oriented, the oblique elongate dimples will not cross but rather will be parallel. For example, referring to FIG. 9, if the upper tube 100 were reversed end-for-end in its orientation and placed atop the lower tube (keeping its face 104 facing upward as shown), the dimples 110*a* on the upper tube would contact the dimples 112*c* on the lower tube, and the dimples 110*c* on the upper tube would contact the dimples 112*a* on the lower tube. In this orientation, these contacting pairs of dimples would be parallel rather than crossing as desired.

Figure 5:
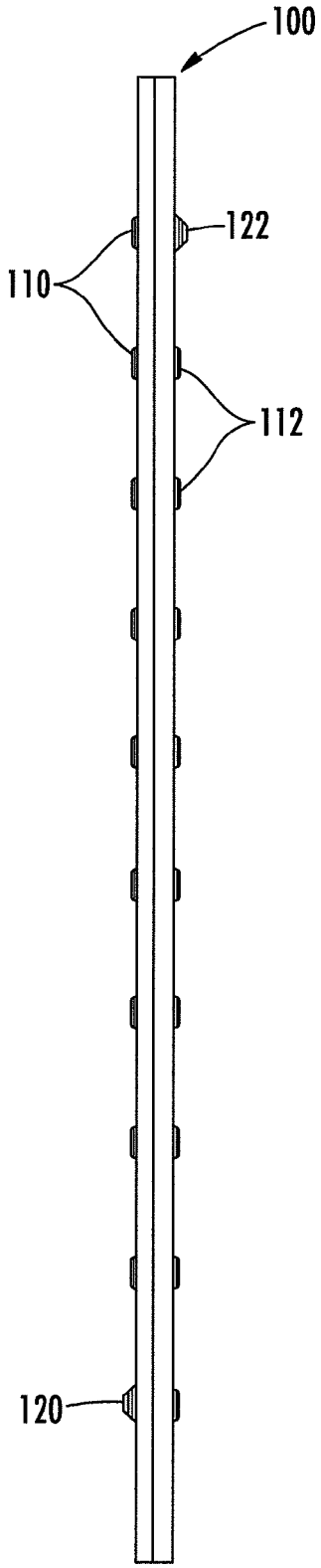
FIG. 5 is a side elevation of the flat tube of FIG. 4.

In order to prevent such improper orientation of the tubes, each tube 100 can include an orientation indicator 120 on the face 102 and a similar orientation indicator 122 on the other face 104 (see FIGS. 4 through 6). The orientation indicators are projections (similar to dimples) that have a height exceeding the height of the dimples 110, 112. In particular, the height of the orientation indicators preferably is at least about 1.2 times the height of the dimples 110, 112, but does not exceed twice the dimple height. The orientation indicator 120 on the face 102 is located adjacent one end of the tube 100, while the orientation indicator 122 on the opposite face 104 is located adjacent the opposite end of the tube. The orientation indicators can have any suitable shape. The orientation indicator 120 on the face 102 is positioned relative to the dimples 112 on the opposite face 104 such that when the tube is stacked with the face 102 opposing the face 104 of another tube, and the two tubes are properly oriented relative to each other, the orientation indicator 120 is aligned with a region of the face 104 that does not have any dimple 112; the orientation indicator 122 on the face 104 likewise is positioned so that it is aligned with a region of the opposing face 102 that does not have any dimple 110 (see FIG. 9). In this proper orientation, the orientation indicators allow the dimples 110, 112 to contact each other as already described.

However, if one tube is reversed end-for-end without rotating it about its longitudinal axis, or is rotated 180° about its longitudinal axis without reversing it end-for-end, and is stacked on the other tube, then the orientation indicator on one tube will contact the orientation indicator on the other tube. This is possible because the orientation indicators exceed about 1.2 times the dimple height, and thus when they are aligned, their contact with each other will prevent the dimples from contacting each other at the end of the tube stack where the orientation indicators are located. It will thus be readily apparent to the worker assembling the tube stack that the tubes are not properly oriented, and the error can be corrected.

Figure 10:
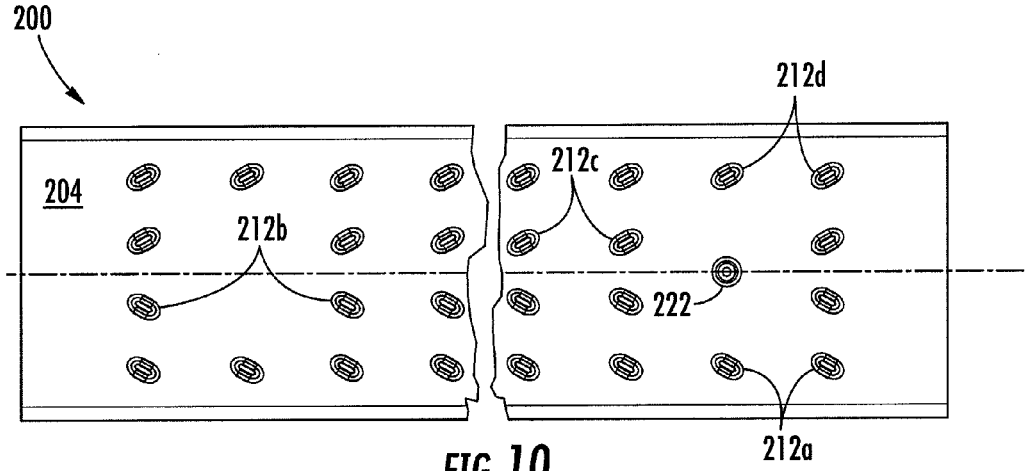
FIG. 10 is a top elevation of a flat tube in accordance with another embodiment of the invention.
Figure 11:
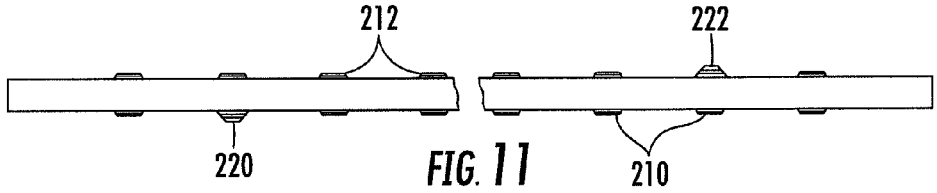
FIG. 11 is a side elevation of the flat tube of FIG. 10.
Figure 12:
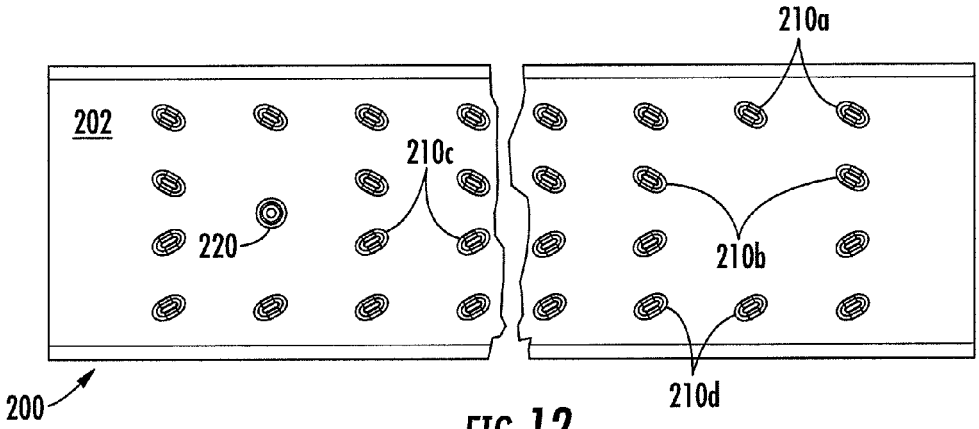
FIG. 12 is a bottom elevation of the flat tube of FIG. 10.

The dimples on the flat tubes in accordance with the invention can be arranged in various ways. The previously described tube 100 has three rows of elongate dimples, but alternatively the dimples can be arranged in two or more rows. For example, FIGS. 10 through 12 show a flat tube 200 in accordance with a second embodiment of the invention, having four rows of elongate dimples 210*a*, 210*b*, 210*c*, 210*d* on one face 202, and four rows of elongate dimples 212*a*, 212*b*, 212*c*, 212*d* on the opposite face 204. The tube 200 has orientation indicators 220, 222 respectively located on the faces 202, 204 in a manner similar to the prior embodiment. The two rows of elongate dimples 210*a*, 210*b* are located on one side of a longitudinal midline of the tube, and the elongate dimples 210*c*, 210*d* are located on the other side of the longitudinal midline. These two groups of rows have the elongate dimples obliquely oriented in opposite directions; more particularly, the dimples 210*a*, 210*b* are oriented with positive angles ($+\alpha$), while the dimples 210*c*, 210*d* are oriented with negative angles ($-\alpha$). When two tubes 200 are stacked with the proper orientation, the dimples 210*a* contact the dimples 212*a* in a crossing configuration similar to what was described previously, and likewise for the dimple pairs 210*b*, 212*b*, the pairs 210*c*, 212*c*, and the pairs 210*d*, 212*d*.

In the tubes 100, 200 described and illustrated thus far, the dimples are arranged in straight rows in the longitudinal direction and also in the widthwise or transverse direction of the tube. This arrangement of the dimples in straight rows in the longitudinal direction enables the tube to be made by roll-forming in a tube rolling mill. Alternatively, if the tube is made by other techniques (e.g., stamping of the sheet followed by bending the sheet into a tube shape), then the dimples may be staggered rather than in straight longitudinal rows.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A tube stack for a heat exchanger, comprising:

a plurality of flat tubes stacked one upon another, each flat tube having substantially flat opposite faces and a plurality of spaced-apart dimples formed on each of the faces, the dimples projecting outwardly away from an interior passage of each tube, a height of the dimples being defined by outermost surfaces of the dimples, at least some of the dimples on each face having an elongate plan shape as viewed perpendicular to the respective face such that each elongate dimple has a length along a major axis greater than a width of the dimple along a minor axis, at least some of the elongate dimples being obliquely oriented with the major axes forming oblique angles with a longitudinal axis of the tube, wherein the obliquely oriented elongate dimples are positioned such that the obliquely oriented elongate dimples on opposing faces of the tubes contact one another to space the opposing faces apart and the major axes of each contacting pair of elongate dimples are non-parallel to each other, wherein the elongate dimples of each flat tube are arranged on each face in a plurality of rows extending parallel to the longitudinal axis and spaced apart in a width direction of the flat tube, wherein the elongate dimples in one of the rows on each face have the major axes oriented substantially parallel to the longitudinal axis of the tube, and the elongate dimples in other rows on each face have the major axes oriented obliquely to the longitudinal axis, and wherein the obliquely oriented elongate dimples in one of the rows on each face have the major axes inclined in an opposite direction from the longitudinal axis in comparison to the obliquely oriented elongate dimples in another of the rows.

2. The-tube stack of claim 1, wherein each flat tube further comprises orientation indicators comprising projections from each face of the flat tube and each having a height exceeding the height of the dimples but not exceeding twice the height of the dimples and located on each of the first and second faces of the flat tube in positions such that when two of the flat tubes are correctly oriented relative to each other in the tube stack the orientation indicators allow the elongate dimples on the opposing faces to contact one another, but when the flat tubes are incorrectly oriented relative to each other the orientation indicator on one flat tube contacts the orientation indicator on the other flat tube and prevents the elongate dimples from contacting one another.

3. The tube stack of claim 2, wherein the orientation indicator on one face of each flat tube is positioned proximate to a first end of the flat tube, and the orientation indicator on the other face is positioned proximate to an opposite second end of the flat tube.

4. The tube stack of claim 2, wherein the height of the orientation indicators is about 1.2 to 2.0 times the height of the dimples.

5. The tube stack of claim 1, wherein there are three and only three rows of elongate dimples on each face.

6. The tube stack of claim 1, wherein the major axes of the obliquely oriented elongate dimples are inclined relative to the longitudinal axis by an angle of about 20°to about 45°.

7. The tube stack of claim 1, wherein the length of each elongate dimple is about 10% to about 30% of a width of the flat tube measured perpendicular to the longitudinal axis between opposite side edges of the flat tube.

8. The tube stack of claim 7, wherein the length of each elongate dimple is at least 1.5 times the width of the elongate dimple.

* * * * *